United States Patent [19]

Files et al.

[11] Patent Number: 4,548,151

[45] Date of Patent: Oct. 22, 1985

[54] REPLACEABLE MARINE FENDER MECHANISM

[75] Inventors: James H. Files; John M. Montague, both of Houston, Tex.

[73] Assignee: La Salle Marine, Inc., Houston, Tex.

[21] Appl. No.: 390,861

[22] Filed: Jun. 22, 1982

Related U.S. Application Data

[63] Continuation of Ser. No. 34,771, Apr. 30, 1979, abandoned.

[51] Int. Cl.[4] ..... B63B 59/02

[52] U.S. Cl. ..... 114/219; 405/212

[58] Field of Search ..... 114/219, 220; 405/211-216; 267/139, 140, 141.3, 141.2

[56] References Cited

U.S. PATENT DOCUMENTS

| | | | |
|---|---|---|---|
| 1,092,731 | 4/1914 | May | 405/214 |
| 2,928,411 | 3/1960 | Johnson | 405/216 |
| 3,235,244 | 2/1966 | Hein | 114/219 |
| 3,306,053 | 2/1967 | Fulton | 114/219 |
| 3,311,081 | 3/1967 | Parker | 114/220 |
| 3,399,880 | 9/1968 | Carlson | 267/153 |
| 3,541,800 | 11/1970 | Walker et al. | 114/219 |
| 3,738,695 | 6/1973 | McBee | 114/219 |
| 3,995,437 | 12/1976 | Drewett | 114/219 |
| 4,005,672 | 2/1977 | Files | 114/219 |
| 4,084,801 | 4/1978 | Landers et al. | 114/219 |
| 4,098,211 | 7/1978 | Files et al. | 114/219 |
| 4,109,474 | 8/1978 | Files et al. | 114/219 |

*Primary Examiner*—Jesus D. Sotelo

*Attorney, Agent, or Firm*—Guy E. Matthews

[57] ABSTRACT

A replaceable marine fender mechanism according to the present invention is adapted for connection to marine structures such as the cylindrical legs of offshore platforms to prevent vessels and other objects from impacting against the platform legs and causing damage. The fender mechanism is supported by upper and lower energy cells with the lower energy cell having a stabbing and positioning receptacle that is adapted to receive a stabbing and positioning portion defined at the lower extremity of an elongated fender post. The upper extremity of the bumper post is releasably supported by a bolted connected structure that is presented at the free extremity of an upper energy cell that is also securable to the leg structure of the offshore platform. A cylindrical fender element is receivable about the fender post and is supported by a connector element to the upper energy absorbing structure. The lower portion of the fender post is provided with internal positioning element that establishes a close fitting relation with the inner peripheral surfaces of the resilient fender and thereby precludes transverse movement of the fender relative to the fender post.

6 Claims, 9 Drawing Figures

REPLACEABLE MARINE FENDER MECHANISM

This is a continuation of application Ser. No. 34,771, filed Apr. 30, 1979, now abandoned.

FIELD OF THE INVENTION

This invention relates generally to fender assemblies for marine structures such as offshore platforms and the like and more particularly relates to a releasable support structure for a vertical fender post having a resilient fender or bumper positioned thereabout and disposed for contact by vessels or other objects that might otherwise cause damage to the marine structure.

BACKGROUND OF THE INVENTION

Bumper fender assemblies are commonly used to protect docks and offshore platforms. Such assemblies typically employ a resiliently encased vertical cylinder which is mounted to a leg of the platform. Typically, the cylinder is encased by a series of stacked resilient cylindrical rings in the manner taught by U.S. Pat. Nos. 3,991,582 and 4,005,672. Heretofore, general maintenance requirements for bumper fendering assemblies have been difficult and time consuming. U.S. Pat. No. 4,005,672 represents an improvement over earlier marine fender designs wherein a main cylinder is supported at the lower extremity by a stab post and is removably connected at the upper extremity thereof to a energy absorbing cell type connection structure. Although somewhat improved, maintenance of bumper fender assemblies remains a difficult and time consuming problem because of the necessity for replacement of one or more of the plurality of damaged cushioning rings that surround the main cylinder. It is desirable, therefore, to provide a marine bumper or fender assembly having a shock resistant impacting portion which portion is simply and easily removable for repair or replacement of the resilient portion thereof.

It is also considered desirable to provide in addition to an impact cushioning portion, an energy absorbing portion that allows substantial transverse movement in the event the mechanism is required to absorb substantial energy. It is desirable, therefore, to provide a marine fender assembly having the capability of absorbing shock forces whether applied centrally or at the upper or lower portions of the fender structure.

Where energy absorbing cells (EAC) are utilized in marine fender assemblies with an elastomeric material being provided as the energy absorbing component, it is at times desirable to provide for resistance to light energy levels and at the same time provide effective resistance to perpendicular forces. At times design conditions require reduced reaction loads into the platform, and thus require a soft energy absorber. Where typical shock cells are employed it is generally considered impractical to provide energy absorbing cells having both of these capabilities.

It is an even further feature of this invention to provide a novel marine fender assembly having elastomer containing energy absorbing cells wherein the elastomer energy absorbing portion thereof is capable of providing reduced reaction loads while at the same time providing effective resistance to transverse forces of substantial magnitude, such as are typically induced when the marine fender is struck in such manner as to define a force vector in angular relation to the centroid of the energy absorbing cell.

It is also a feature of this invention to provide a novel marine fender mechanism wherein vertical force components acting on the energy absorbing members are effectively minimized.

Other and further objects, advantages and features of the invention will become obvious to one skilled in the art upon an understanding of the illustrative embodiments about to be described and various advantages, not referred to herein, will occur to one skilled in the art upon employment of the invention in practice.

SUMMARY OF THE INVENTION

The present invention is directed to the provision of a marine fender assembly that is connectable to marine structures such as offshore platforms, floating drilling vessels and the like in order to provide such marine structures with protection against the damaging effects that might occur as the result of being impacted by other marine vessels and structures. The marine bumper mechanism is adapted for interconnection with the marine structure by upper and lower energy absorbing cells that will yield in controllable manner whether the bumper structure is impacted at the upper, lower or intermediate portions thereof. An elongated bumper post is provided, having a stabbing element at the lower portion thereof that is adapted to be received by a stabbing and positioning receptacle defined at the free extremity of the lower energy absorbing cell. A generally cylindrical wear sleeve is positioned about the bumper post and cooperates with the bumper post to define an annular space or annulus therebetween. In one embodiment of the invention, a semi-circular portion of this annular space or annulus is substantially filled with an elongated semi-circular body of elastomeric, shock-absorbing material the annular space on the opposite side of the bumper is maintained by a plurality of centralizer elements that extend radially outwardly from the bumper post. In another embodiment of the invention, the annular space or annulus is completely filled with a cylindrical body of resilient, shock-absorbing material. Whether the energy absorbing resilient member is of semi-cylindrical configuration or of cylindrical configuration is determined solely by design preference.

At the free extremity of the upper energy absorbing cell, bumper connection structure is provided in order to facilitate releasable retention of the upper portion of the bumper post and, when released, this releasable connection allows complete separation of the bumper assembly from both the upper and lower energy absorbing cells in order that repair or replacement may be accomplished simply and efficiently offshore. The lower energy absorbing cell is adapted for releasable connection to the marine structure by means of bolted connection in order that the lower shock absorbing cell, which is intended for underwater positioning, may be simply and efficiently removed for repair or replacement.

The elastomeric portion of the energy absorbing cell may be designed so as to provide a range of energy absorption capacities and yet provide effective resistance against transverse loads.

BRIEF DESCRIPTION OF THE DRAWINGS

In order that the manner in which the above-recited advantages and features of the invention are attained as well as others which will become apparent can be understood in detail, more particular description of the invention briefly summarized above may be had by reference to the specific embodiments thereof that are illustrated in the appended drawings, which drawings form a part of this specification. It is to be understood, however, that the appended drawings illustrate only typical embodiments of the invention and are therefore not to be considered limiting of its scope, for the invention may admit to other equally effective embodiments.

In the Drawings.

DESCRIPTION OF PREFERRED EMBODIMENTS

Figure 1:
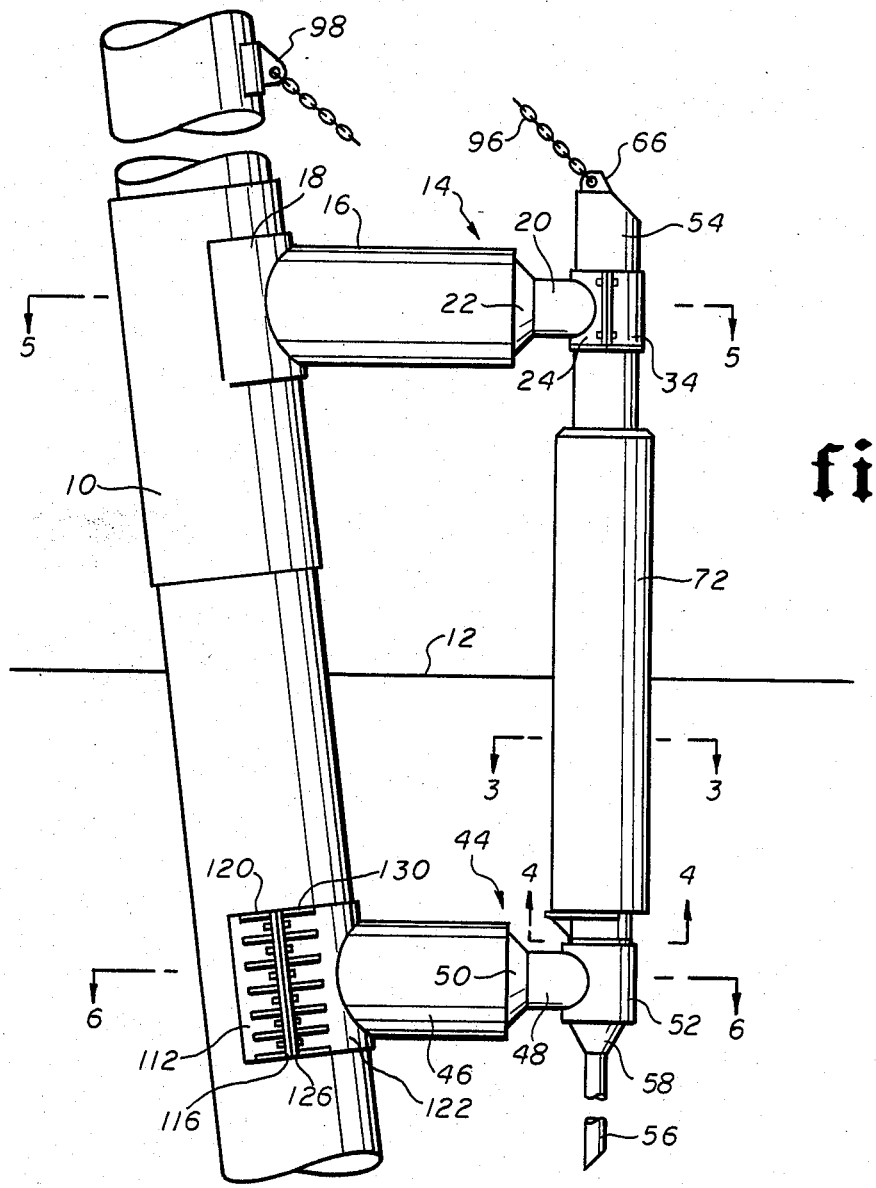
FIG. 1 is a partial elevational view of a marine structure such as the leg of an offshore platform having a marine bumper mechanism connected thereto which mechanism is constructed in accordance with the present invention.

Referring now to the drawings and first to FIG. 1, there is illustrated a marine structure at 10 which may be one of a plurality of legs of a marine offshore platform that is submerged to a mean low water elevation 12. The marine structure 10 may be a drilling platform, a production platform or a portion of a floating drilling or production vessel, such as is used in the petroleum industry for drilling completion and production of offshore petroleum producing formations. During drilling and production activities, it is frequently necessary for service vessels to be positioned quite close to such marine structures for transfer of supplies and personnel to and from the marine structure and for the purpose of conducting various service operations. Although it is typically desirable for marine vessels to remain clear of such marine structures to prevent damage thereto under circumstances of severe wave action, it is well known that service vessels can subject the marine structure to severe impacts the marine structure and/or the service vessel can become severely damaged due to wave action induced impact and expensive repair operations then may be required. It is desirable to provide marine structures, such as offshore platforms and the like, with energy absorbing means to resist impact by service vessels. According to the present invention, a marine fender mechanism may be interconnected with the marine structure to provide such desired protection.

Figure 5:
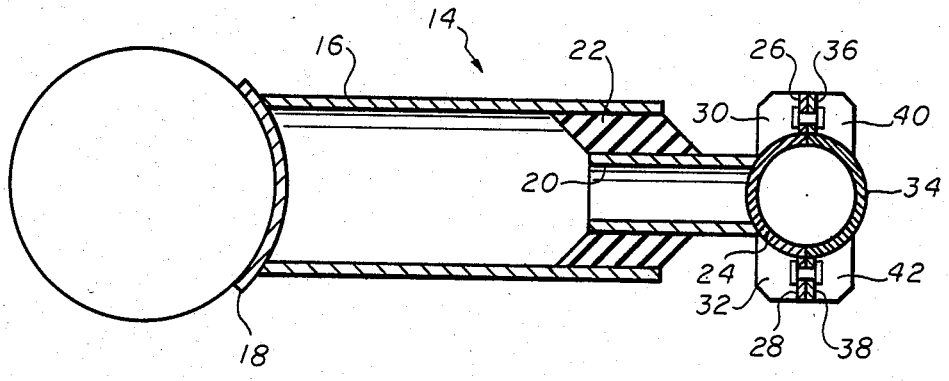
FIG. 5 is a transverse sectional view of the marine fender mechanism taken along line 5—5 of FIG. 1.

As shown in FIGS. 1 and 5, an upper energy absorbing cell, shown generally at 14, may include an outer cylindrical portion 16 having a connection saddle 18 fixed at one extremity thereof by welding or the like. The connection saddle 18 is adapted to be connected to a cylindrical leg portion of the marine structure by welding, thus supporting the outer cylindrical portion 16 of the shock absorbing cell in substantially horizontal manner. The energy absorbing cell 14 is also provided with a connector portion 20 that is maintained in movable telescoping relation with the outer portion 16 of the energy absorbing cell by means of an annular resilient energy absorbing member 22 formed of rubber or any other suitable resilient, elastomeric material. At the outer extremity of the inner telescoping element 20 is provided a semicylindrical connector section 24 having a pair of bolt flanges 26 and 28 interconnected therewith by welding or the like. A pair of gusset members 30 and 32 interconnect the bolt flanges 26 and 28 with the semicylindrical section 24 and provide a strengthening and force transitioning capability for the structure. A semicylindrical clamping element 34 is provided having bolt flanges 36 and 38 connected thereto which flanges are strengthened by means of gusset elements 40 and 42. A plurality of bolt apertures are formed in the bolt flanges 26, 28, 36 and 38 and bolts are inserted through these apertures after the clamping element 34 has been properly positioned with respect to the semicylindrical section 24.

A lower energy absorbing cell is shown generally at 44 and is defined by an outer generally cylindrical member 46 that is stationary with respect to the marine structure and a movable inner cylindrical portion 48 that is supported in movable telescoping relation with the outer portion 46 by means of an annular resilient energy absorbing body element 50. The resilient body element 50 may be composed of rubber or any one of a number of suitable commercially available rubber-like materials and may be bonded to the inner periphery of the outer element 50 and to the outer periphery of the inner element 48. At the free extremity of the inner movable telescoping element 48 is provided an annular stabbing and positioning ring 52, the cylindrical positioning element or ring 52 being interconnected with the movable telescoping element 48 by means of welding or any other suitable form of connection.

The marine bumper assembly incorporates an elongated fender post element 54 having a stabbing and positioning portion at the lower extremity thereof defined by an elongated small diameter stabbing element 56 that is interconnected with the post structure 54 by means of a tapered transitioning element 58. Although the fender post 54 and the various other components thereof are illustrated of generally circular cross-sectional configuration, it is not intended by such to limit the invention in any manner whatever. It is intended various fender post structures of other than circular cross-sectional configuration may be utilized within the spirit and scope of the present invention. The lower extremity of the stabbing element 56 is closed by means of a closure plate 60 that may be welded or otherwise fixed to the lower extremity of the stabbing element. The closure plate 60 provides a seal for the bumper post structure and effectively prevents sea water from entering the bumper post and causing corrosion.

The cylindrical outer surface of the fender post defines a cylindrical positioning surface 62 at the lower extremity of the post structure which is of a size for close fitting relation within the stabbing and positioning ring element 52 supported by the lower energy absorbing cell 44. In order to limit insertion of the post into the positioning ring 52, an annular stop flange 64 is secured to the post structure by welding or the like and is adapted to engage the upper portion of the positioning ring 52, thereby limiting further downward movement of the post relative to the positioning ring. The upper extremity of the fender post 54 is secured relative to the upper energy absorbing cell 14 by a cylindrical clamp structure defined by the semicylindrical clamp sections 24 and 34 which clamp sections are connectable in assembly by bolts in the manner described above. This clamp structure establishes sufficient frictional fit with the outer periphery of the fender post so that upward movement of the post is precluded with respect to the upper and lower energy absorbing cells.

At the upper extremity of the fender post 54 is provided a tension connector element 66 that is welded to the internal structure of the post. The upper extremity of the post is closed by means of closure plate elements 68 and 70 to prevent introduction of sea water into the hollow post 54. The tension connector element 66 extends upwardly through the closure plate 70 and is interconnected with the closure plate by means of welding or the like. Thus, the upper and lower extremities of the post 54 are completely closed and protection is therefore provided against internal corrosion of the post structure.

The fender assembly includes a wear element 72 that is formed of a rigid material such as steel or a suitable wear resistant plastic material. The wear element is positioned about the fender post 54 and cooperates with the outer cylindrical surface of the fender post to define an annular space or annulus 74. The annulus is divided into a pair of generally semicylindrical chambers by means of a pair of elongated partition elements 76 and 78 that are secured to the fender post structure by means of welding or the like. Within the outermost one of the generally semicylindrical chambers is positioned a generally semicylindrical shock absorbing body or insert 80 composed of resilient material such as rubber or any other suitable rubber-like material. The resilient body 80 is adapted to yield under shock loads as the fender assembly is struck by a marine vessel, thereby providing a cushioning, shock resisting cability.

Figure 3:
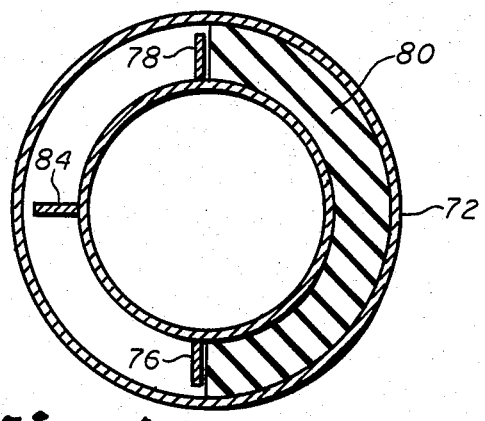
FIG. 3 is a transverse sectional view taken along line 3—3 of FIG. 1.
Figure 4:
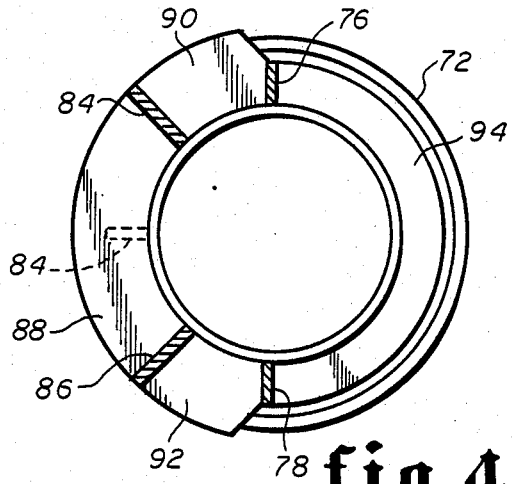
FIG. 4 is a transverse sectional view taken along line 4—4 of FIG. 1.
Figure 2:
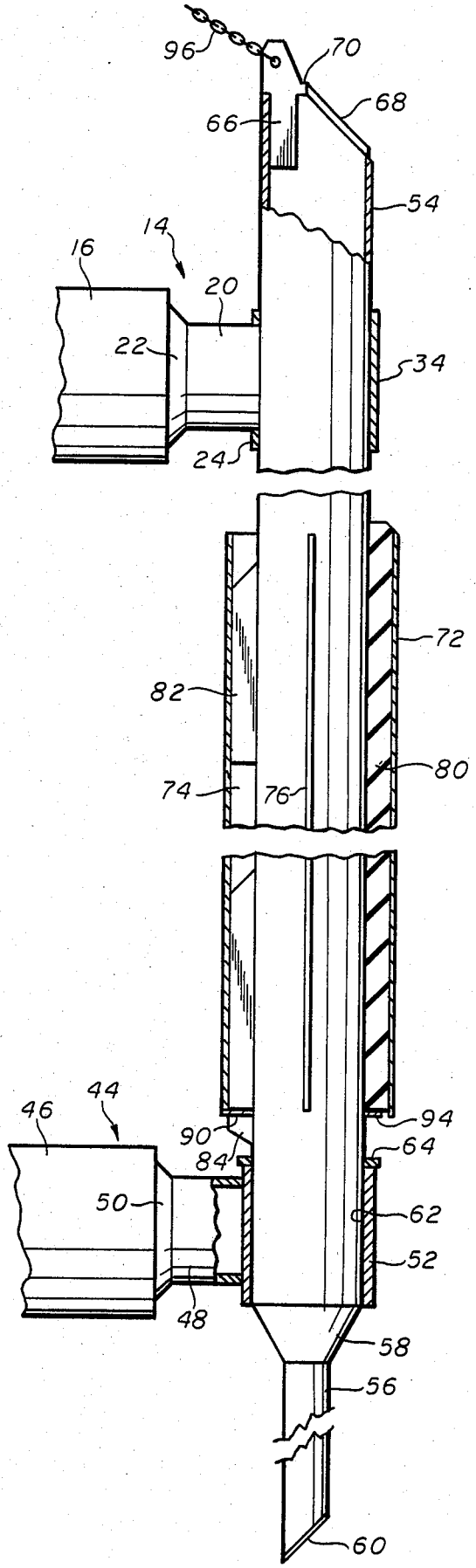
FIG. 2 is a sectional view of the marine fender mechanism of FIG. 1 illustrating the internal parts thereof in detail.

Referring now to FIGS. 2, 3 and 4, an upper pair of centralizer elements 82 are interconnected with the outer periphery of the fender post 54 by means of welding and are located within the annulus 74 when the wear element 72 is properly positioned with respect to the fender post. Centralizer elements 82 serve to maintain proper spacing between the wear element and fender post and allow relative movement of the wear element 72 relative to the fender post when the resilient body 80 is compressed by impact forces. As shown particularly in FIGS. 1 and 4, a pair of lower centralizer elements 84 and 86 are also interconnected with the lower portion of the fender post 54 by means of welding and are also positionable within the annulus 74 when the wear element 72 is properly positioned with respect to the fender post. As shown in FIG. 2, the wear elements 84 and 86 extend slightly below the level of the wear element 72. A plurality of support plate segments 88, 90, 92 and 94 are interconnected with the lower portion of the fender post 54 by means of welding and are also connected respectively with the centralizer elements 84 and 86 and with the partition elements 76 and 78 to provide sufficient strengthening capability. The inside portion of the support plate structure defined by plate segments 88, 90 and 92 is of sufficient dimension to provide adequate support for the wear element 72 while the outside support plate structure defined by plate segment 94 provides adequate support for the internal semicylindrical resilient body 80.

The upper extremity of the fender post 54 is secured with respect to the marine structure by means of a tension connector element 96 such as a chain or cable with one and thereof secured to a connector structure 98 that is welded or otherwise fixed to the marine structure. In the event a service vessel should apply a tension force to the fender structure in any manner whatever, this tension force will be resisted by the action of the upper energy absorbing cell 14 and resistance will also be provided by the tension chain or cable 96 thereby providing protection for the fender structure. The tension element also provides a means for lifting the fender assembly during installation and service operations.

INSTALLATION AND REMOVAL

With the energy absorbing cells 14 and 44 in position as shown in FIG. 1 and with the outer semicylindrical clamp section 34 removed, the fender assembly including the wear element 72 with its partition and centralizer elements attached and with the semicylindrical resilient body 80 in position with the annulus, will simply be lowered from the marine structure or from a service vessel causing the stabbing element 56 to enter the stabbing and positioning ring element 52 provided at the free extremity of the lower energy absorbing cell. The small dimension of the stabbing element 56 allows ready insertion of the stabbing element into the stabbing and positioning ring 52. The conical transitioning portion 58 serves a camming function as the fender post 54 is further lowered, thereby causing the cylindrical lower portion 62 of the fender post to move into close fitting relation within the positioning ring 52. Upon becoming fully inserted into the positioning ring, the stop flange 64 will engage the upper portion of the positioning ring, thereby limiting further downward movement of the fender assembly. After this has been accomplished, the upper portion of the fender post 54 will be positioned within the semicylindrical saddle defined by the upper semicylindrical clamp portion 24 at the free extremity of the upper energy absorbing cell. The outer semicylindrical clamp element 34 then may be assembled about the upper extremity of the fender post by bolting. After the tension chain or cable 96 has been interconnected between connector elements 66 and 98, the installation procedure will be complete.

Assuming that it is desired to replace the internal semicylindrical resilient portion 80 or to replace the outer wear element 72 of the fender structure, the fender may be simply and efficiently removed from its connection with the marine structure. This may be accomplished simply by unbolting and removing the clamp section 34 from clamp section 24. With the upper extremity released in this manner, a lifting chain, cable or other device may be secured to the tension element 96 which will function as a lifting chain or cable in this case. The fender assembly then may be simply lifted to such extent that the stabbing and positioning portion at the lower extremity of the fender post clears the positioning element 52. After the fender assembly has been transported to the marine structure or service vessel for repair, the wear element 72 may be removed from the fender post simply by moving it upwardly from the support plate structure relative to the fender post. After the wear element has been removed, the semicylindrical resilient body structure 80 may be readily replaced.

Figure 7:
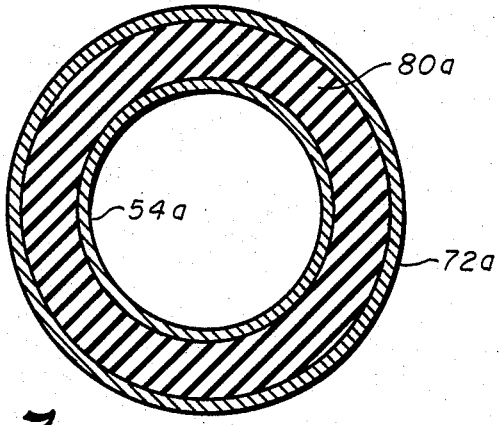
FIG. 7 is a transverse sectional view of a marine fender structure representing an alternative embodiment of the invention wherein the shock absorbing element is of substantially cylindrical configuration.
Figure 9:
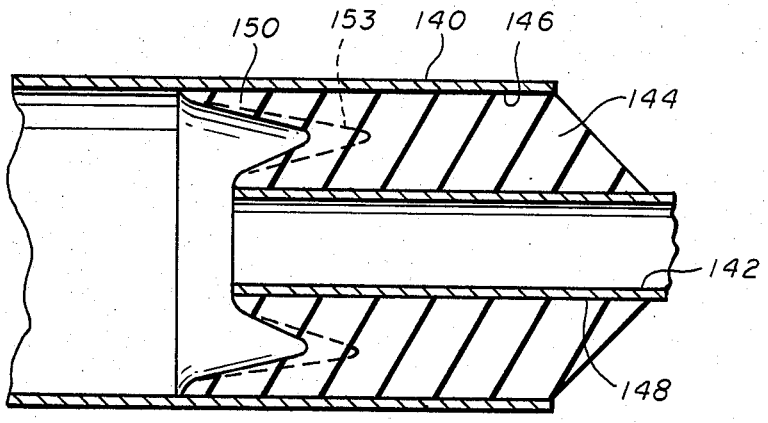
FIG. 9 is a partial sectional view of an energy absorbing cell structure illustrating an energy absorbing cell structure wherein rotational resistance, cushioning capability and reaction forces are controlled by the design of the energy absorbing body.

With reference now to FIG. 7, it may be desirable from the standpoint of design preference and economy to provide a marine fender assembly incorporating a resilient shock absorbing element of cylindrical configuration as opposed to being semicylindrical as shown in FIGS. 2 and 3. In this event, the fender structure may conveniently take the form illustrated in FIG. 7, including an outer wear element 72*a* is adapted to rest on support plate structure in the same manner as described above in connection with FIG. 2. A cylindrical resilient body 80*a* is positioned within the annulus defined between the fender post 54*a* and the wear element 72*a*. The resilient body 80*a* also rests upon a support plate structure such as illustrated in FIGS. 2 and 4. Where a completely cylindrical resilient body is employed as shown in FIGS. 7 and 9, it is, of course, unnecessary to provide partitioning and centralizer elements such as are discussed above in connection with FIG. 2. The cylindrical resilient body will completely fill the annulus between the fender post 54*a* and the wear element 72*a* and the fender structure will be resistant to tension, as well as compressive loads.

Figure 6:
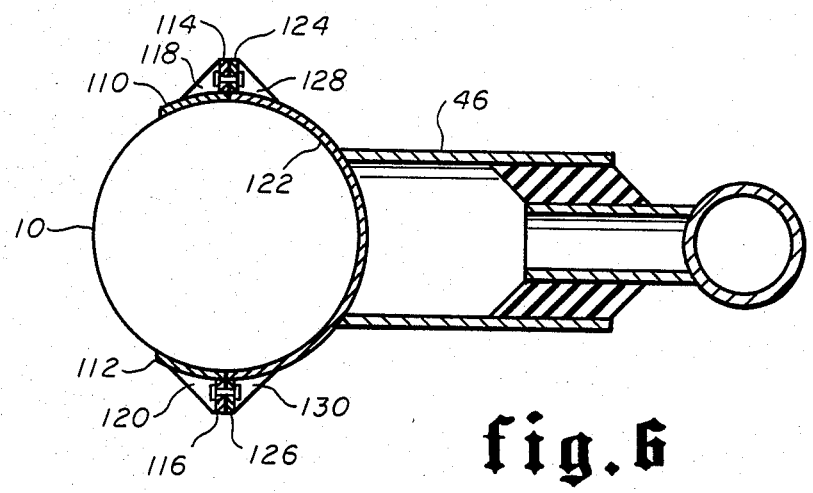
FIG. 6 is a transverse sectional view of the marine fender mechanism taken along line 6—6 of FIG. 1.

As illustrated in FIGS. 1 and 6, the lower energy absorbing cell 44 is intended for bolted connection to the marine structure 10. A pair of bolt flange structures 110 and 112 are adapted to be secured to the marine structure by welding. A pair of bolt flanges 114 and 116 are connected to the bolt flange structures and are strengthened by means of a plurality of gusset elements 118 and 120. The cylindrical outer portion 46 of the lower energy absorbing cell is provided with a saddle portion 122 having bolt flanges 124 and 126 interconnected therewith and strengthened by means of a plurality of gusset elements 128 and 130. Bolt apertures are formed in the respective bolt flanges and thus the saddle support for the lower energy absorbing cell 44 may be secured to the marine structure by means of bolting. In the event it should become necessary to remove the lower energy absorbing cell 44 for purposes of repair or replacement, such removal may be accomplished efficiently even though the lower energy absorbing cell is intended for placement in submerged condition beneath the mean low water elevation 12.

Figure 8:
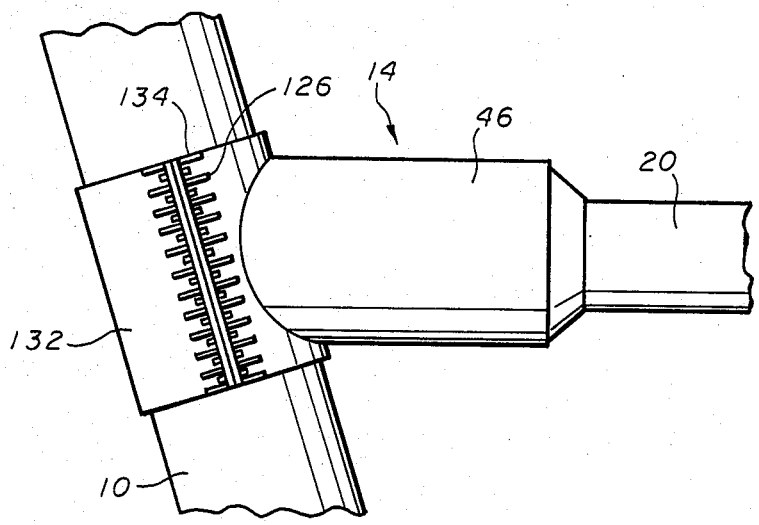
FIG. 8 is a partial elevational view of a marine fender structure representing a further alternative embodiment of this invention and illustrating bolted assembly of the lower energy absorbing cell to the marine structure.

In the event it should be desirable to install the marine fender assembly on existing marine structures such as offshore platforms that are already on permanent location, the lower energy absorbing cell structure may be modified in the manner illustrated in FIG. 8. The energy absorbing cell 46 and its connection flange structure may take the same form shown in FIG. 6. For the reason that installation must be accomplished in a submerged environment, the mechanism may be provided with a partially cylindrical clamp structure 132 having a pair of bolt flanges 134 formed thereon in the manner shown in FIG. 6. The bolt flanges 134 are capable of being secured in bolted assembly with the flanges 124 and 126 FIG. 6. Assembly and disassembly may be accomplished by means of bolted connection by service personnel such as divers working in shallow conditions.

In many cases, it is desirable to provide energy absorbing cell structures having the capability of effectively reducing or controlling reactive loads. Where conventional energy absorbing cells are employed, it is typically desirable that energy absorbing cell structures provide effective resistance to rotation under the influence of transverse shock loads as well as providing reduced reactive forces. In order to provide for proper cushioning capability and yet provide effective resistance to rotation, the energy cell construction may conveniently take the form shown in FIG. 9 where an outer tubular element 140 is provided, defining the outer cylindrical portion of the energy absorbing cell. An inner tubular element 142 is also provided which defines a telescopically movable element that is positioned in centered relation within the outer tubular element 140. An annular energy absorbing body 144 composed of any suitable elastomeric material such as rubber, synthetic rubber or the like, is bonded to the inner cylindrical surface 146 of the the tubular element 140 and is also bonded to the outer peripheral surface 148 of the inner tubular element 142. To provide for designed cushioning capability under light impact loads and to provide reduced reactive forces, the annular elastomeric body 144 is formed in such manner as to define an annular groove 150 or cut-away portion that reduces the resistance of the body 144 to axial loads during energy absorbing activity. As shown in broken line in FIG. 9 to further reduce the resistance of the body 144 to impact loads, the annular groove or cut-away portion may be enlarged to the extent shown in broken line. Thus, to provide designed resistance to impact forces and to provide for designed control of reactive forces, it is simply appropriate to form the annular groove or cut-away portion 150, 153 of sufficient size to provide the desired impact cushioning capability.

The energy absorbing cell design illustrated in FIG. 9 provides maximum bonded surface area between the elastomer body 144 and the inner and outer tubular elements. Upon application of a transverse force that might cause rotation or pivoting of the inner tubular element 142 relative to the outer tubular element, the substantial amount of surface area that exists between the rigid and yieldable elements will effectively resist relative rotational movement of the rigid components, thus the energy absorbing cell structure may be conveniently designed to accomplish controlled cushioning without detracting from the resistance thereof to rotational forces.

In view of the foregoing, it is readily apparent that the present invention accomplishes all of the features and advantages hereinabove set forth, together with other advantages which will become obvious and inherent from a description of the apparatus itself. It will be understood that certain combinations and subcombinations are of utility and may be employed without reference to other features and such combinations. This is contemplated by and is within the scope of the present invention.

As many possible embodiments may be made of this invention without departing from the spirit or scope thereof, it is to be understood that all matters hereinabove set forth are shown in the accompaying drawings are to be interpreted as illustrative and not in any limiting sense.

What is claimed is:

1. A replaceable marine fender mechanism for protecting a marine structure from damage by impact forces, said fender mechanism comprising:

a lower energy absorbing support being releasably connectable to said marine structure;

an upper energy absorbing support being connectable to said marine structure at a position above said lower energy absorbing support;

an elongated fender post connectable between said upper and lower energy absorbing supports;

a tubular metal wear resisting element being positionable about said fender post and cooperating with said fender post to define chamber means therebetween;

a pair of opposed elongated partition elements extending radially outwardly from said fender post cooperating with said fender post and said wear resisting element to define inner and outer chambers of generally semi-circular cross-sectional configuration; and an elongated resilient shock absorbing body of generally semi-circular cross-sectional configuration received within said outer chamber.

2. A replaceable marine fender mechanism as recited in claim 1 including:

centralizer means being positioned within said inner chamber for maintaining minimum spacing of said fender post and wear resistant member.

3. A replaceable marine fender mechanism as recited in claim 2 wherein said fender mechanism includes:

transverse support means being connected to said fender post; and said wear resistant element and said resilient shock absorbing body being supported by said transverse support means.

4. A replaceable marine fender for protecting a marine structure from damage by impact by marine vessels, said fender mechanism comprising:

a lower support adapted for interconnection with said marine structure wherein said lower support defines a stabbing and positioning receptacle;

an upper support adapted for interconnection with said marine structure and defining a fender connection;

an elongated fender post defining a stabbing element at the lower extremity thereof, said post being adapted for connection between said upper and lower supports;

a generally rigid tubular wear resistant element being receivable about said fender post and cooperating with said post to define a chamber therebetween;

a resilient shock absorbing body element being located within said chamber and being deformable upon application of impact loads against said wear resistant element, thus allowing relative movement between said wear resistant element and said fender post; and, wherein said chamber includes means defining at least one outer elongated chamber of generally semi-circular, cross-sectional configuration and wherein said resilient shock absorbing body element is of a mating configuration and dimension with said elongated chamber, and further including means in said chamber for maintaining said shock absorbing body element within said outer chamber.

5. A replaceable marine fender for protecting a marine structure from damage by impact by marine vessels, said fender mechanism comprising:

a lower support adapted for interconnection with said marine structure wherein said lower support defines a stabbing and positioning receptacle;

an upper support adapted for interconnection with said marine structure and defining a fender connection;

an elongated fender post defining a stabbing element at the lower extremity thereof, said post being adapted for connection between said upper and lower supports;

a generally rigid tubular wear resistant element being receivable about said fender post and cooperating with said post to define a chamber therebetween;

a resilient shock absorbing body element being located within said chamber and being deformable upon application of impact loads against said wear resistant element, thus allowing relative movement between said wear resistant element and said fender post; and, wherein a pair of opposed elongated partition elements extend radially outward from said fender post and cooperate with said post and said wear resistant element to define an outer chamber of generally semi-circular, cross-sectional configuration and wherein said resilient shock absorbing body is of a generally semi-circular, cross-sectional configuration and is receivable within said outer chamber.

6. A replaceable marine fender for protecting a marine structure from damage by impact by marine vessels, said fender mechanism comprising:

a lower support adapted for interconnection with said marine structure wherein said lower support defines a stabbing and positioning receptacle;

an upper support adapted for interconnection with said marine structure and defining a fender connection;

an elongated fender post defining a stabbing element at the lower extremity thereof, said post being adapted for connection between said upper and lower supports;

a generally rigid tubular wear resistant element being receivable about said fender post and cooperating with said post to define a chamber therebetween;

a resilient shock absorbing body element being located within said chamber and being deformable upon application of impact loads against said wear resistant element, thus allowing relative movement between said wear resistant element and said fender post;

partition elements dividing the chamber between the fender post and wear resistant element into inner and outer generally semi-circular chambers; and wherein said resilient shock absorbing body element is of a generally semi-circular, cross-sectional configuration and is receivable within said outer chamber and wherein a centralizer means is positioned within said inner chamber and maintains minimum spacing of said fender post and wear resistant element.

* * * * *